US005564250A

United States Patent [19]

Kessler

[11] Patent Number: 5,564,250

[45] Date of Patent: Oct. 15, 1996

[54] INSULATION SYSTEM

[76] Inventor: John A. Kessler, 11507 Rosehill, Overland Park, Kans. 66210

[21] Appl. No.: 179,257

[22] Filed: Jan. 10, 1994

Related U.S. Application Data

[63] Continuation of Ser. No. 651,574, Feb. 6, 1991, Pat. No. 5,357,722.

[51] Int. Cl.[6] ..... E04G 23/00

[52] U.S. Cl. ..... 52/741.4; 52/407.4

[58] Field of Search ..... 52/22, 90.1, 92.1, 52/93.1, 95, 198, 199, 302.1, 302.3, 404.1, 406.1, 407.1, 407.4, 506.06, 741.1, 743, 746, 741.4

[56] References Cited

U.S. PATENT DOCUMENTS

| | | |
|---|---|---|
| 2,785,099 | 3/1957 | Holtsford . |
| 3,204,383 | 9/1965 | Adams . |
| 3,343,314 | 9/1967 | Smith . |
| 3,835,604 | 9/1974 | Hoffmann, Jr. . |
| 4,103,674 | 8/1978 | Robinson, Jr. et al. . |
| 4,333,292 | 6/1982 | Musgrave . |
| 4,391,075 | 7/1983 | Musgrave . |
| 4,528,790 | 7/1985 | Lo et al. . |
| 4,545,166 | 10/1985 | Kielmeyer . |
| 4,637,188 | 1/1987 | Crothers . |
| 4,677,903 | 7/1987 | Mathews, III . |
| 4,724,651 | 2/1988 | Fligg . |
| 4,735,026 | 4/1988 | Forsythe . |
| 4,819,397 | 4/1989 | Gerndt . |

FOREIGN PATENT DOCUMENTS

| | | |
|---|---|---|
| 211598 | 7/1984 | Germany . |
| 108023 | 3/1925 | Switzerland . |
| 905298 | 9/1962 | United Kingdom . |

*Primary Examiner*—Michael Safavi
*Attorney, Agent, or Firm*—Litman, McMahon and Brown, L.L.C.

[57] ABSTRACT

An insulation system for metal buildings, having a roof structure formed by roof panels supported on parallel, relatively narrowly-spaced purlins which are, in turn, supported on parallel, relatively widely-spaced main support beams, comprises a plurality of adjacently positioned strips of insulating material suspended below the roof structure so as to form a relatively flat and continuous surface. The strips of insulating material are supported on a system of insulation support tube strings suspended from and extending in parallel spaced relation to selected purlins. Each insulation support tube string runs the entire length of the building in spaced and transverse relationship to the main support beams.

3 Claims, 2 Drawing Sheets

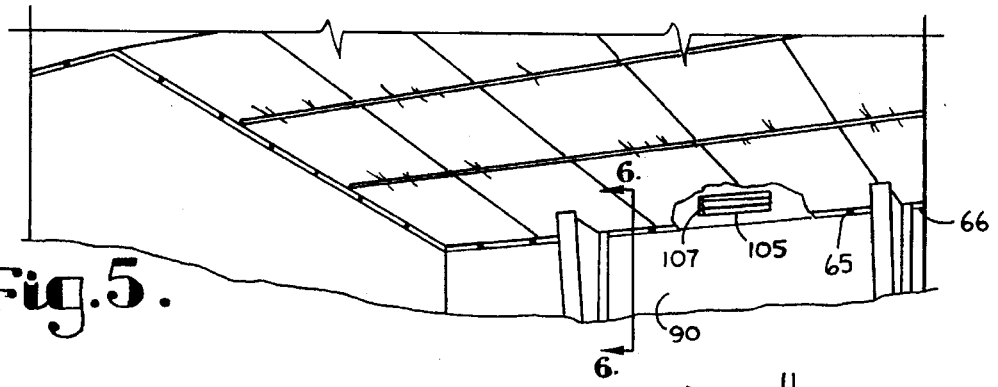
Fig.5.
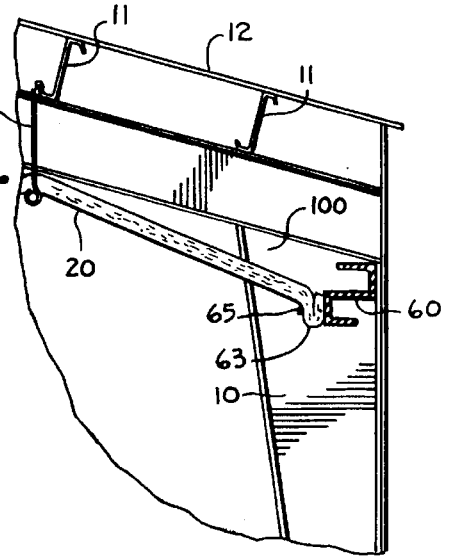
Fig.6.
Fig.7.
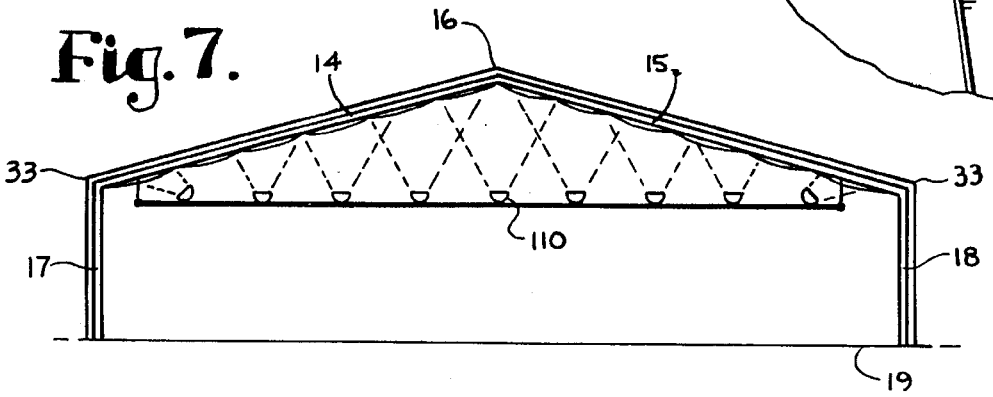
Fig.8.
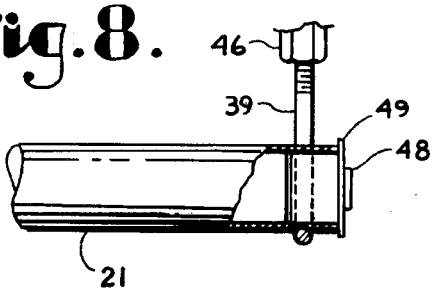

INSULATION SYSTEM

CROSS REFERENCE TO RELATED APPLICATION

The present application is a continuation of U.S. application for patent Ser. No. 07/651,574 filed Feb. 6, 1991, entitled INSULATION SYSTEM, now Pat. No. 5,357,722.

BACKGROUND OF THE INVENTION

The present invention relates to an insulating system for metal buildings and, in particular, to such a system which is suspended from the ceiling of metal buildings.

Various methods and systems have been developed to insulate the ceilings or roof structure of corrugated sheet metal. The roof structure of most metal buildings comprises metal sheets supported on a support structure of cross-members or purlins running the length of the building which are in turn supported on spaced, rib-like I-beams or main support beams.

One common practice is to insulate a metal building during construction by installing blankets or strips of insulation on top of the cross-members prior to installing the final layer of sheet metal forming the roof. This practice interferes with the completion of the building itself and leaves the lower and inside support structure of the roof exposed. Leaving the support structure of the roof exposed results in the main support beams extending about one foot below the ceiling. Such extension by the main beams increases maintenance costs, because cleaning is required, and results in a very uneven surface that is difficult to light, because the main beams block and prevent dispersion of light reflected off the ceiling. The compression of the insulation between the cross-members and metal sheets forming the roof also reduces the efficiency of the insulation.

U.S. Pat. No. 4,391,075 discloses an insulation system particularly adapted for insulating metal buildings having pitched roofs. In the system disclosed in U.S. Pat. No. 4,391,075, blankets of insulation are supported against the lower surface of the purlins of the roof structure by a system of tubes suspended from the purlins. The tubes are suspended from the purlins so as to extend parallel thereto between adjacent support beams such that the support beams extend substantially below the insulation supported on the tubes. The extension of the support beams below the insulation results in increased maintenance costs and in an uneven surface that is difficult to light. The exposed support beams also serve as direct heating and cooling conductors that bypass the insulation.

Historically, there has been a reluctance to construct buildings of this type, with any space between the sheet metal, the insulation and the inner ceiling, due to collection of vapor condensation within such a space and resulting problems. Further, historically, such a space was not ventilated to reduce vapor condensation because the prior art ceilings were not airtight and ventilation would draw too much heated or cooled air from the building, thereby rendering the insulation ineffective. In particular, practice in using conventional insulation systems is shown in U.S. Pat. No. 4,391,075 which teaches the elimination of the airspace between the blankets of insulation supported on the tubes and the metal sheets of the roof by the insertion of additional insulation therebetween. The airspace is eliminated to reduce the likelihood of water vapor condensing therein.

SUMMARY OF THE INVENTION

The present invention provides an insulating system adapted for use with metal buildings wherein the roof structure is generally formed from a series of cross-members or purlins supported by and extending perpendicularly to a series of support beams, I-beams or girders. The insulation system generally comprises a series of support tubes that are suspended from the purlins so as to be suspended below both the purlins and the support beams. Individual lengths of support tube are joined together to form a single support tube string which extends across the entire length of the building in spaced and parallel relation to a single purlin and so as to be spaced below and extend in perpendicular alignment to the support beams. Support tube strings may be suspended from each purlin or selected equally-spaced purlins depending on spacing requirements needed to adequately support insulation on the tubes.

Strips of insulating material having a light-reflecting backing are strung across the support tube strings so as to extend generally from the eaves of the building to the peak in perpendicular alignment with the support tube strings. The insulating material is supported on the support tubes such that a light-reflecting backing is directed downward and the adjacently-aligned strips of insulating material form a generally flat, uninterrupted and continuous surface of the light-reflecting material with variations due to sagging, joining or the like being sufficiently small so as to not hamper effective distribution of indirect lighting reflected off of the surface.

OBJECTS AND ADVANTAGES OF THE INVENTION

Therefore, the objects of the present invention are: to provide an insulating system for metal buildings; to provide such a system that is suspendable from the roof structure of a metal building; to provide such a system wherein insulating material is suspended below the support structure of the roof structure so as to form a generally flat and uninterrupted surface; to provide such a system that is particularly well adapted for reflecting indirect lighting downward; to provide such a system that reduces the likelihood of condensation in the space between the insulating material and the roof; to provide such a system that is relatively easy to install; to provide such a system that requires little maintenance; to provide such a system that reduces maintenance requirements to the building structure itself; and to provide such a system that effectively insulates a metal building.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 5 is a fragmentary and perspective view of the insulation system secured to the roof structure of the metal building on a reduced scale, with portions broken away to show interior detail thereof.

FIG. 6 is a fragmentary and cross-sectional view of the insulation system on a reduced scale, taken along lines 6—6 of FIG. 5.

FIG. 7 is a side cross-sectional view of the insulation system secured to the roof structure of the metal building on a reduced scale.

FIG. 8 is an enlarged and fragmentary view of an end of an insulation support tube string suspended by the hangar assembly of the insulation system, with portions broken away to illustrate detail thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
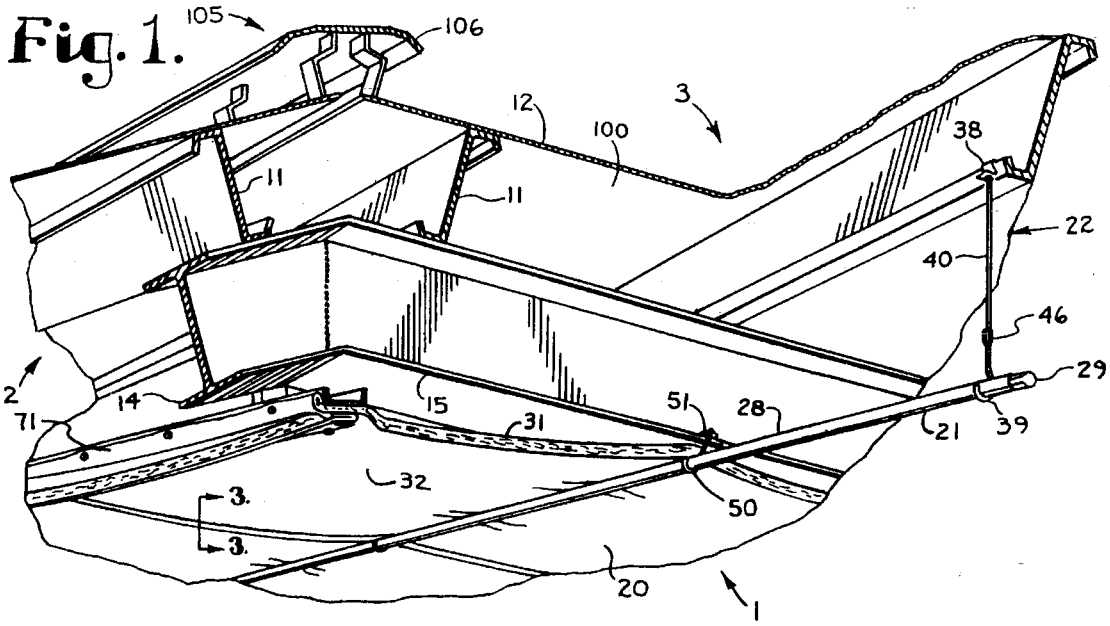
FIG. 1 is a fragmentary, perspective view of the insulation system of the present invention secured to the roof structure of a metal building.
Figure 2:
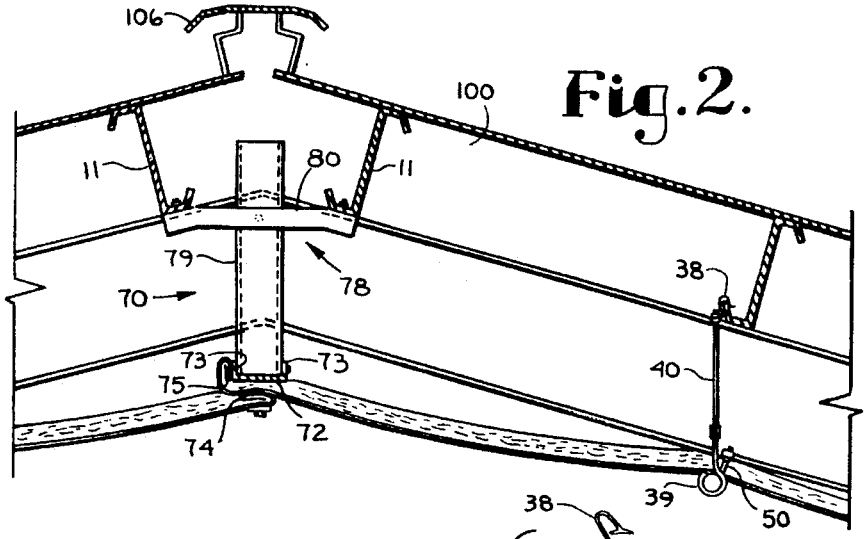
FIG. 2 is a fragmentary and cross-sectional view of the roof structure and insulation system.

Referring to the drawings in more detail, FIG. 1 illustrates an insulation system 1 of the present invention secured to a roof structure 2 of a metal building 3. The roof structure 2 comprises a plurality of parallel, spaced main support beams, I-beams or girders 10 and a plurality of cross-members or purlins 11 supported by and extending transversely of the main support beams 10 in parallel and horizontal spaced relation. The main support beams 10 extend into an interior of the building 3 with an unfinished ceiling eight to twelve inches or more, much like a series of ribs. A plurality of corrugated metal sheets or roof panels 12 are secured to and supported by the purlins 11. Each main support beam 10 includes a first arm 14 and a second arm 15 angled upward toward each other to give the roof structure 2 pitch and to form a peak 16. The first and second arms 14 and 15 of each main support beam 10 are supported by a first leg 17 and a second leg 18 respectively, each of which extends to and is supported by a base or foundation 19 of the building 3.

The insulation system 1 generally comprises strips of insulating material or insulation strips 20 supported on a plurality of insulation support members or insulation support tube strings 21 which are suspended from the roof structure 2 by hangar assemblies 22. Each insulation support tube string 21 is formed from a plurality of tube sections 28 connected in axial alignment by tube connection means, such as compressible connector sleeves 29, which are removably securable within opposed ends of adjacently-aligned tube sections 28. Each insulation support tube string 21 is suspended from a purlin 11 so as to extend in parallel and spaced relation thereto along the entire length of the building 3 below and transversely with respect to the main support beams 10.

Insulation support tube strings 21 are suspended from each purlin 11 or, alternatively, from an equally-spaced selected number of purlins 11 adequate to support the insulation strips 20 to be supported thereon. Insulation strips 20, comprising a fibrous glass insulation blanket 31 or other suitable types of insulation having a facing 32 secured thereto, are strung in adjacent alignment from opposed eaves 33 of the building 3 to the peak 16 across the suspended insulation support tube strings 21. The width of the insulation blankets 31 may be varied but is generally three, four or five feet. The facing 32 on each insulation strip 20 is wider than the insulation blanket 31 such that the facing 32 extends beyond the edges of the insulation blanket 31 so as to form a flap 34. The flap 34 generally extends three inches beyond either edge of the insulation blanket 31.

Figure 3:
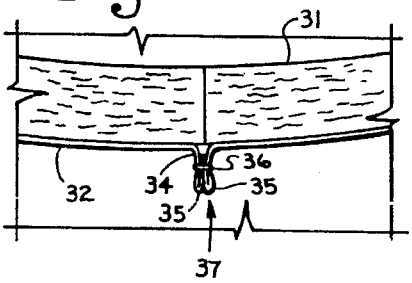
FIG. 3 is an enlarged, fragmentary and cross-sectional view of the insulation system, showing a seam thereof, taken along lines 3—3 of FIG. 1.
Figure 4:
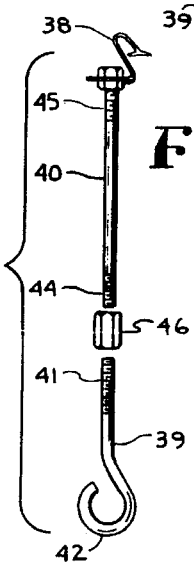
FIG. 4 is an enlarged and exploded view of a hanger assembly of the insulation system.

As shown in FIG. 3, the insulation strips 20 are aligned such that the insulation blankets 31 of adjacently-aligned insulation strips 20 are positioned in abutting relationship and the adjacent flaps 34 of each insulation strip 20 extend downward therefrom. The adjacent flaps 34 are folded over towards one another to form opposed folds 35. The folds 35 are secured together by fastening means, such as staples 36, to form a seam 37. The adjacent folds 35 tend to bias inward towards one another to form a vapor seal.

The hangar assemblies which are used to suspend the insulation support tube strings 21 from the purlins 11 generally comprise a purlin clip 38, an eye bolt 39 and an extension rod 40. The purlin clips 38 are adapted to be securely fastenable to a lower edge of a purlin 11. The eye bolts 39 include a threaded bolt end 41 and a hooked end 42. The hooked end 42 is adapted to be slidably securable over a tube section 28 with the threaded bolt end 41 extending radially outward therefrom. The extension rods 40 include a first threaded end 44 and a second threaded end 45. The first threaded end 44 is axially aligned with and secured to a threaded bolt end 41 of an eye bolt 39 by a connector 46. The second threaded end 45 is threadingly secured to a purlin clip 38 such that, when the purlin clip 38 is secured to a purlin 11, the extension rod 40 and the eye bolt 39 extend vertically downward from the purlin 11.

The hanger assemblies 22 extend from the insulation support tube strings 21 to the purlins 11 in between each insulation strip 20 or between selected insulation strips 20. The hanger assemblies 22 preferably extend through the seam 37 formed between adjacent insulation strips 20. Hanger assemblies 22 also extend from the ends of each insulation support tube string 21 to respective purlins 11.

A cap or bushing 48 is secured in each end of each insulation support tube string 21. A lip 49 on each bushing 48 extends beyond the outer periphery of the tube section 28 in which it is secured so as to cover any sharp edges on the end of the tube section 28. The lip 49 is also wider than the diameter of the hooked end 42 of the eye bolt 39 of a hanger assembly 22 so as to prevent the hooked end 42 of the eye bolt 39 from slipping off the end of the insulation support tube string 21.

Secondary tube support assemblies 50, each comprising an I-beam clip 51 and an eye bolt 39, securable to the insulation support tube strings 21 and main support beams 10 provide rigidity to the insulation system 1. The I-beam clips 51 are adapted to be securely fastenable to a main support beam 10. Hooked ends 42 of the eye bolts 39 are encirclingly secured to a tube section 28 and threaded bolt ends 41 of the eye bolts 39 are threadingly secured to an I-beam clip 51. The secondary tube support assemblies 50 also preferably extend through the seam 37 of adjacently-aligned insulation strips 20.

Each insulation strip 20 is preferably secured at an eave 33 of the building 3 and at the peak 16. Eave struts 60 are secured to and extend transversely to the first legs 17 and the second legs 18 associated with the main support beams 10 so as to extend just below the main support beams 10. One end of each insulation strip 20 is secured to an eave strut 60. At the eave strut 60, the end of the insulation strip 20 is folded back over itself to form a folded portion 63 such that the facing 32 is directed outwards at the folded portion 63. The folded portion 63 is then positioned against the eave strut 60 and secured into place by screws 65 and a termination bar 66, as seen in FIG. 6.

At the peak 16 of the building 3, a wall or insulation attachment structure 70 is built into the roof structure 2 to provide a horizontal surface extending the entire length of the building 3 below the main support beams 10 onto which ends of the insulation strips 20 may be attached. The wall 70 comprises a horizontal attachment member 71 extending the length of the building 3. The horizontal attachment member 71 generally includes a lower surface 72 and upstanding legs 73. The horizontal attachment member 71 is secured below the main support beams 10 by a plurality of spaced support members 78. Each support member 78 includes a vertical member 79 and a cross-member 80. Each cross-member 80 is secured to and extends between the uppermost purlins 11 on opposite sides of the peak 16. Each vertical member 79 is secured to a cross-member 80 and extends downward therefrom. The horizontal attachment member 71 is secured to the lower ends of each of the vertical members 79 of the support members 78.

The distal ends 74 of the insulation strips 20 originating at the eave 33 of one side of the building 3 are folded over and fastened to the upstanding leg 73 on the horizontal attachment member 71 opposite of the side from which the insulation strip 20 originated. The ends 75 of the insulation strips 20 originating at the eave 33 on the other side of the building 3 are then folded over and fastened to the lower surface 72 of the horizontal attachment member 71 over the insulation strip 20 originating at the opposite eave 33. The insulation strips 20 are fastened to the horizontal attachment member 71 by fastening means such as screws 65 and termination bar 66.

The insulation system 1 of the present invention is also utilized to insulate the side walls 90 of a building 3. To insulate a side wall 90, the insulation strips 20 are extended over an insulation support tube string 21 suspended from the purlin 11 closest to the eave 33 down to the base 19 of the building 3. The insulation strips 20 are then fastened at the base 19 of the building 3. If the building to be insulated is relatively small, individual insulation strips 20 may be strung from one eave 33 to the peak 16 and down to the other eave 33.

When the insulation system 1 is installed, an airspace 100 is formed between the adjacently-aligned insulation strips and the roof structure 2. Ventilation means, such as static ventilators 105 and preferably ridge vent 106 and eave vents 107, are included in or added to the roof structure 2 to allow outside air to circulate through the airspace 100. The circulation of outside air through the airspace 100 reduces the likelihood of condensation in the insulation system 1 by allowing circulating air to remove vapors trapped in the airspace 100, while the sealing of the insulation blanket facings 32 at the folds 35 prevents any substantial amount of heated or cooled air from within the insulated portion of the building 3 from being drawn out by the ventilation means.

When the insulation system 1 is installed, the adjacently-aligned insulation strips 20 on opposite sides of the peak 16 form relatively flat or smooth surfaces extending the entire length of the building 3 in conforming relationship with the roof line of the building 3. Because of the low profile of the tube sections 28, folds 35 and any slight sagging of the facing 32 between the tube sections 28, the surface presented on each side of the peak 16 is suitable for use as a reflector for indirect lighting and provides a clean and aesthetically pleasing appearance. The facing 32 of the insulation strips 20 is preferably made of material having a high light reflectance. Light from light sources 110, shown in FIG. 7 and being positioned below the insulation system 1, is reflected off the facing 32 of the insulation strips 20 and back down to the space enclosed by the building 3. The uninterrupted, relatively flat surface formed by the insulation system 1, incorporating a facing 32 having a high reflectance, greatly increases the efficiency of existing light sources 110 or reduces the amount of lighting required to adequately light the space enclosed by the building 3.

It is noted that the present invention synergistically combines a ceiling construction and an insulation construction into a single insulation system that advantageously uses a highly effective insulative blanket that is not compressed as in the prior art.

It is foreseen that the present invention can be utilized in conjunction with types of construction other than the illustrated metal building, for example, wood construction.

It is also foreseen that in certain constructions, the invention could be utilized in conjunction with buildings having roof structure without pitch or wherein the support tube strings may be aligned perpendicular to purlins of the roof.

It is to be understood that while certain forms of the present invention have been illustrated and described herein, it is not to be limited to the specific forms or arrangement of parts described and shown.

What is claimed and desired to be secured by Letters Patent is as follows:

1. A method for forming a sealing seam between adjacently-aligned strips of insulating material located below an enclosed region subject to the build up of condensation within the region, the insulating material having a fibrous glass insulation blanket and a facing such that said facing is wider than said fibrous glass insulation blanket so as to form flaps extending beyond opposed sides of said fibrous glass insulation blanket and to form a generally continuous lower ceiling surface from said facing; said method comprising:

(a) directing said flaps of said adjacently-aligned strips of insulating material downward;

(b) folding each of said adjacently-aligned flaps back over upon itself and towards the other adjacently-aligned flap so as to form adjacently-aligned folds; and (c) securing said folds in adjacent alignment; and (d) ventilating the region above the upper side of the facing with at least one ventilator so as to substantially exchange air above said facing with outside air so as to reduce the likelihood of condensation buildup on said insulation blanket.

2. The method as described in claim 1, including the step of:

(a) securing said folds in adjacent alignment by stapling.

3. A method for insulating a building having a roof structure of parallel and relatively widely-spaced main support beams, parallel and relatively narrowly-spaced purlins supported by and extending perpendicularly to said main support beams and a plurality of roof panels mounted in covering relationship to said purlins; said method comprising:

(a) suspending strips of insulating material from said purlins such that said strips of insulating material are suspended below said main support beams and are joined so as to extend from an eave of said building to a peak of said building and to extend generally continuously between opposite ends of said building, (b) ventilating with at least one ventilator a space formed between said strips of insulating material and said roof structure so as to exchange air in said space with outside air to reduce the likelihood of condensation on said material.

* * * * *